United States Patent [19]

McMickle et al.

[11] 4,255,880

[45] Mar. 17, 1981

[54] PORTABLE ROTARY SNOW THROWER

[75] Inventors: Robert L. McMickle; Gary B. Ader; Steven L. Grice, all of Spirit Lake, Iowa

[73] Assignee: Berkley and Company, Inc., Spirit Lake, Iowa

[21] Appl. No.: 51,375

[22] Filed: Jun. 25, 1979

[51] Int. Cl.[3] ..... E01H 5/00

[52] U.S. Cl. ..... 37/43 B

[58] Field of Search ..... 37/43 R, 43 A, 43 B, 37/43 F, 43 L, 53

[56] References Cited

U.S. PATENT DOCUMENTS

| | | | |
|---|---|---|---|
| 3,199,235 | 8/1965 | Stacey | 37/43 R |
| 3,200,519 | 8/1965 | Kennedy | 37/43 R |
| 3,512,279 | 5/1970 | Benson | 37/43 R |
| 3,907,040 | 9/1975 | Trusty | 37/53 X |
| 4,062,135 | 12/1977 | Dobberpuhl | 37/43 R |

*Primary Examiner*—E. H. Eickholt

*Attorney, Agent, or Firm*—Schroeder, Siegfried, Ryan, Vidas, Steffey & Arrett

[57] ABSTRACT

A portable rotary snow thrower is disclosed. The housing of the snow thrower is baffled to cause the snow to be thrown to one side for a particular direction of rotation of the rotor. The rotor may also be rotated in the opposite direction to throw the snow to the opposite side of the snow thrower through the same opening without repositioning of baffles or other mechanical elements.

3 Claims, 3 Drawing Figures

Fig. 3
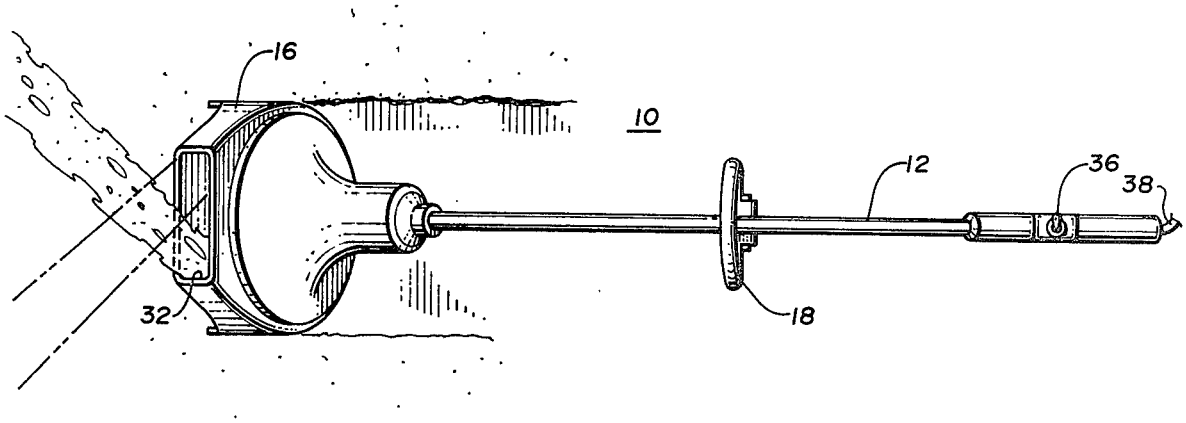
Fig. 1
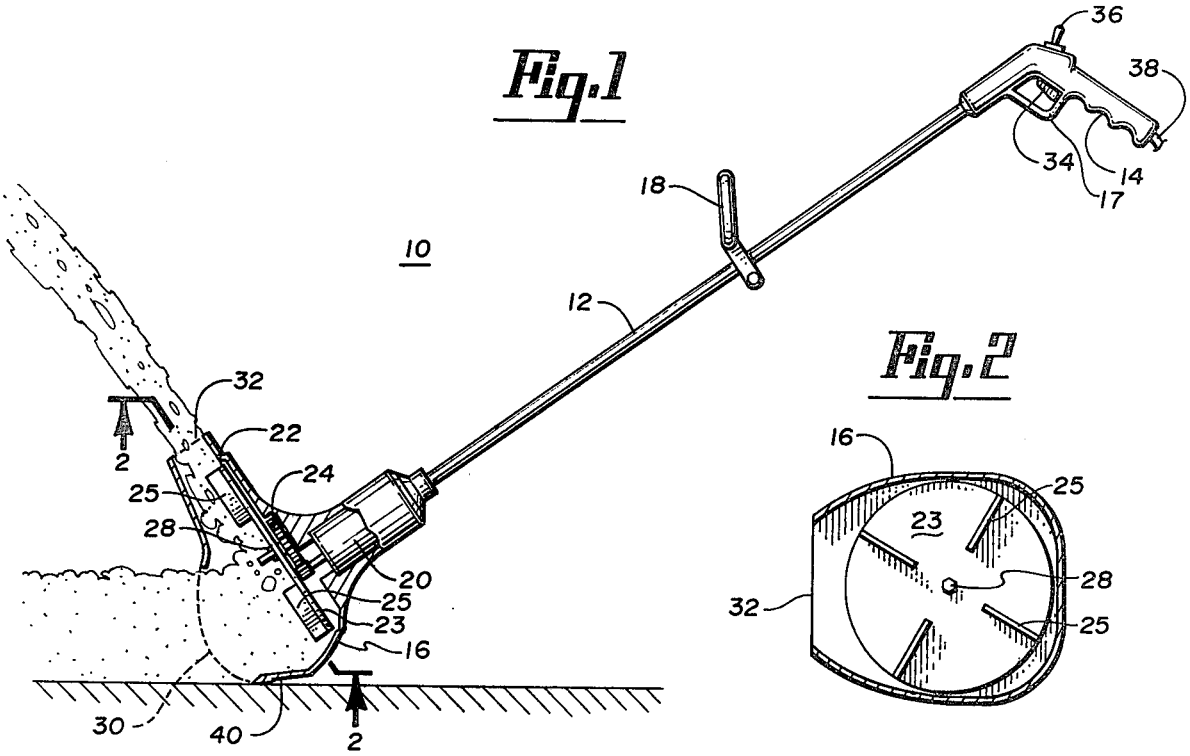
Fig. 2

PORTABLE ROTARY SNOW THROWER

DESCRIPTION

BACKGROUND OF THE INVENTION

This invention relates to a portable snow thrower, and more particularly to a portable snow thrower which can throw snow to either side of the snow thrower without manipulation of mechanical baffles or similar snow directing elements.

In the prior art, as exemplified by U.S. Pat. No. 3,199,235, relating to a portable snow thrower, and U.S. Pat. Nos. 1,701,767 and 3,800,448, which relate to rotary snow throwers, snowthrowers are discussed which utilize a rotating disc with generally perpendicular blades on its surface to propel a stream of snow to one side of the snow thrower. The snow throwers in U.S. Pat. Nos. 3,199,235 and 3,800,448 can only be operated to throw the snow to one side of the machine. No provision is made for throwing snow to the opposite side. The snow plow shown in U.S. Pat. No. 1,701,767 utilizes two chutes which connect to the snow thrower housing. A system of manually operated interlocked doors opens one or the other of the chutes to provide for throwing the snow to a selected side of the machine.

The problem with existing snow throwers is that none of them provide a simple arrangement for selecting the direction of thrown snow which is suitable for use on a portable machine. Mechanical arrangements add weight and complexity and do not throw snow to both sides of the machine with equal efficiency.

SUMMARY OF THE INVENTION

In accordance with one aspect of this invention, there is provided a snow throwing device which is readily portable. The device includes a handle, a housing attached to one end of the handle, and having a collecting opening for receiving snow to be thrown as the device is advanced, and a discharge opening positioned on the top of the housing. The device also comprises a rotor mounted for rotation about an axis generally parallel to the handle, and including at least one blade mounted on the face of the rotor generally perpendicular to the plane of the rotor to engage snow received in said housing through said collecting opening. The device also comprises motor means constructed and arranged to rotate the rotor about its axis to throw snow engaged by said rotor through the discharge opening of said housing.

BRIEF DESCRIPTION OF THE DRAWINGS

A preferred embodiment of the subject invention is hereafter described with reference being made to the following figures, in which:

FIG. 1 is a side elevation view of the snow thrower;

FIG. 2 is a cross sectional view showing the interior of the housing; and

FIG. 3 is a top plan view of the device.

DESCRIPTION OF THE PREFERRED EMBODIMENT

Referring now to FIG. 1, a snow thrower 10 is shown which includes an extended handle or shaft 12 with a hand grip 14 at one end and a housing 16 attached to its other end. Hand grip 14 includes a trigger guard 17.

An intermediate handle in the form of a loop or a ring 18 is attached along the length of the extended handle or shaft 12. The intermediate handle permits the user of the snow thrower to hold it in one hand using the intermediate handle and the other hand using the pistol grip 14. Since the snow thrower is light weight, it can be easily lifted by the user to scoop at deep snow if desired.

As shown in FIG. 1, the housing 16 encloses an electric motor or drive means 20 which drives a rotor 22 through a suitable transmission or gearing arrangement 24. As shown in FIGS. 1 and 2, the rotor 22 is comprised of a disc portion 23 and one or more paddles or blades 25 which are mounted on the disc 23. In the embodiment shown, the discs are perpendicular to the surface of the blade and are positioned on radii of the disc. The disc is driven by a shaft 28 from the transmission 24.

The housing 16 has a collecting opening 30 along its bottom portion and a discharge opening 32 located symmetrically at its top. As shown in FIG. 3, the snow being thrown from the discharge opening 32 is projected to the right side of the snow thrower when viewed by an operator holding the device in the normal manner. The direction of rotation of the rotor 22 to achieve the pattern shown in FIG. 3 is clockwise when viewed from the operator's position.

In order to provide the snow blower with the ability to throw snow to either side of the machine, the preferred embodiment of the snow thrower shown utilizes a reversible electric motor 20 to drive the blower 22. The motor is controlled by an on/off switch 34, which is a normally open spring biased switch requiring constant operator pressure to remain in the on position. A further switch 36 is used for changing the direction of rotation, of electric motor 20. Switch 36 is a two position switch positioned at the top of the hand grip 14 for actuation by the thumb of the user. The electric power to drive motor 20 is provided by a cord 38 of the conventional insulated grounded three wire variety.

It is, of course, realized that the particular arrangement of the handle is subject to variation without departing from the spirit of the invention. For example, the reversing switch 36 could be located at another location on the snow thrower or combined in some known manner with the on/off switch 34. Similarly, it may be desirable to provide further means to prevent inadvertent actuation of the motor. Such further means might include another switch mounted on loop 18 wired in conjunction with switch 34 to require actuation of both switches before the motor 20 is permitted to run. Such an arrangement would thus require both of the operator's hands to be in position to actuate the machine.

A further safety feature could also be a position sensitive switch mounted on the unit to prevent actuation of the motor unless the unit is in the operating position shown in FIG. 1. If the unit is inverted to remove packed snow, it could not then be energized even if switch 34 were actuated.

The interior of housing 16 of the snow thrower is relatively unobstruced to minimize the possibility of snow or ice building up within the housing. The housing has a flattened rear lip 40 which allows the snow thrower to be slid along the ground with the handle 12 elevated approximately 35 degrees above the ground for comfortable operation by the user. At that angle, the snow is thrown to the front and side of the machine to avoid throwing snow in the vicinity of the operator behind the machine.

Obviously, many other modifications and variations to the present invention are possible in light of the above teachings. For example, a small pair of wheels could be attached to the housing in the vicinity of the rear lip 40 to facilitate movement of the snow thrower along the ground. Such wheels, however, are not necessary to assure adequate operation of the machine. It may also be possible to provide a transmission 24 which provides the reversibility of the direction of rotation of the rotor 22 when used with a unidirectional drive means or motor 20, or a reciprocating gasoline engine. It is therefore to be understood that, within the scope of the appended claims, the invention may be practiced otherwise than as specifically described.

I claim:

1. A portable snow throwing device, said device comprising, in combination:

a handle;

a housing means attached to one end of said handle, said housing means having a collecting opening for receiving snow to be thrown as said device is advanced and a discharge opening positioned at the midpoint of said housing means along its longitudinal axis and above the collecting opening;

a disc shaped rotor mounted for rotation about an axis of said rotor disc generally parallel to the axis of said handle, said rotor including at least one blade mounted on the face of said rotor generally perpendicular to the plane of the rotor to engage snow received in said housing through said collecting opening; and reversible drive means constructed and arranged to rotate said rotor about its axis to throw snow engaged by said rotor through the discharge opening of said housing to one side of said device when said rotor is rotated in one direction of rotation and to the other side of said device when said rotor is rotated in the opposite direction.

2. The invention claimed in claim 1 wherein said drive means is a reversible motor and wherein said further means comprises control means for reversing the direction of rotation of said motor.

3. The invention claimed in claim 1 wherein said drive means is an electric motor including on/off switch means requiring constant finger pressure by the operator to maintain the switch in the on position.

* * * * *